US011098394B2

(12) United States Patent
Matsui et al.

(10) Patent No.: US 11,098,394 B2
(45) Date of Patent: Aug. 24, 2021

(54) ROLLED WIRE ROD

(71) Applicant: NIPPON STEEL & SUMITOMO METAL CORPORATION, Tokyo (JP)

(72) Inventors: Naoki Matsui, Tokyo (JP); Yutaka Neishi, Tokyo (JP); Makoto Kosaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 183 days.

(21) Appl. No.: 16/312,225

(22) PCT Filed: Jul. 5, 2017

(86) PCT No.: PCT/JP2017/024715

§ 371 (c)(1),
(2) Date: Dec. 20, 2018

(87) PCT Pub. No.: WO2018/008703

PCT Pub. Date: Jan. 11, 2018

(65) Prior Publication Data

US 2019/0233925 A1 Aug. 1, 2019

(30) Foreign Application Priority Data

Jul. 5, 2016 (JP) ..... JP2016-133379

(51) Int. Cl.
*C22C 38/32* (2006.01)
*C22C 38/54* (2006.01)
(Continued)

(52) U.S. Cl.
CPC ..... *C22C 38/32* (2013.01); *C22C 38/00* (2013.01); *C22C 38/001* (2013.01);
(Continued)

(58) Field of Classification Search
CPC ..... C22C 38/32; C22C 38/54; C22C 38/00; C22C 38/001; C22C 38/002; C22C 38/02;
(Continued)

(56) References Cited

U.S. PATENT DOCUMENTS 6,551,419 B2 * 4/2003 Kanisawa ..... C21D 8/06 148/320
6,602,359 B1 * 8/2003 Ochi ..... C21D 8/06 148/330
(Continued)

FOREIGN PATENT DOCUMENTS

CA 2966479 A1 5/2016
JP 9-104945 A 4/1997
(Continued)

OTHER PUBLICATIONS

International Preliminary Report on Patentability and Written Opinion of the International Searching Authority (Forms PCT/IB/326, PCT/IB/373 and PCT/ISA/237) for International Application No. PCT/JP2017/024715, dated Jan. 17, 2019, with English translation of the Written Opinion.
(Continued)

*Primary Examiner* — John A Hevey
(74) *Attorney, Agent, or Firm* — Birch, Stewart, Kolasch & Birch, LLP

(57) ABSTRACT

A rolled wire rod wherein the contents of Ti, N, and S (mass %) are respectively [Ti], [N], and [S], and, if [S]≤0.0010, [Ti] is (4.5×[S]+3.4×[N]) or more and (0.008+3.4×[N]) or less, while if [S]≥0.0010, [Ti] is (4.5×[S]+3.4×[N]) or more and (8.0×[S]+3.4×[N]) or less, the internal structure is a mixed structure of ferrite and pearlite with an area ratio of a ferrite fraction of 40% or more, and a mean area of sulfides present in a range from a surface of the wire rod to a depth position D/8 from the surface of the wire rod is 6 $\mu m^2$ or less, wherein D represents a diameter, in mm, in a cross-section
(Continued)

of the wire rod at a plane including the axis of the wire rod, and a mean aspect ratio of the sulfides is 5 or less.

7 Claims, 2 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/42*** | (2006.01) |
| ***C21D 8/06*** | (2006.01) |
| ***C21D 9/52*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/42* (2013.01); *C22C 38/54* (2013.01); *C21D 8/06* (2013.01); *C21D 8/065* (2013.01); *C21D 9/525* (2013.01); *C21D 2211/005* (2013.01); *C21D 2211/009* (2013.01)

(58) Field of Classification Search
CPC ..... C22C 38/04; C22C 38/06; C22C 38/20; C22C 38/22; C22C 38/24; C22C 38/26; C22C 38/28; C22C 38/42; C22C 38/50; C21D 8/06; C21D 8/065; C21D 9/525; C21D 2211/005; C21D 2211/009
See application file for complete search history.

(56) References Cited

U.S. PATENT DOCUMENTS

| | | | | |
|---|---|---|---|---|
| 2007/0095439 | A1 | 5/2007 | Yoshihara | |
| 2015/0007904 | A1* | 1/2015 | Tanizawa ..... | B23K 9/0253 138/171 |
| 2015/0041029 | A1 | 2/2015 | Yamashita et al. | |
| 2017/0335426 | A1 | 11/2017 | Matsui et al. | |

FOREIGN PATENT DOCUMENTS

| | | | |
|---|---|---|---|
| JP | 2000-192148 | A | 7/2000 |
| JP | 3443285 | B2 | 9/2003 |
| JP | 5486634 | B2 | 5/2014 |
| KR | 10-0802237 | B1 | 2/2008 |
| WO | WO 2013/183648 | A1 | 12/2013 |
| WO | WO 2016/080315 | A1 | 5/2016 |

OTHER PUBLICATIONS

International Search Report (form PCT/ISA/210) for International Application No. PCT/JP2017/024715 dated Sep. 26, 2017, with English Translation.
Extended European Search Report for corresponding European Application No. 17824306.9, dated Nov. 7, 2019.
Korean Office Action for corresponding Korean Application No. 10-2018-7026958, dated Oct. 14, 2019, with an English translation.

* cited by examiner

ROLLED WIRE ROD

FIELD

The present invention relates to a rod-shaped or wire-shaped rolled steel able to be used as a material for a cold forged part (below, referred to as a "rolled wire rod").

BACKGROUND

A part produced by cold forging (cold forged part) is excellent in surface skin or dimensional precision, is lower in manufacturing cost, and further is also excellent in yield compared with a part produced by hot forging (hot forged part). For this reason, cold forged parts are being widely used as parts for machine structural use (gears, shafts, bolts, etc.) used for automobiles and various industrial machinery and parts for building structures.

In recent years, in parts for machine structural use, parts are increasingly being made smaller in size and lighter in weight, while in parts for building structure use, parts are increasingly being made larger in size, so cold forged parts, regardless of size, are desirably made much greater in strength.

These cold forged parts include ones made of steel materials of carbon steel for machine structural use of JIS G 4051, steel materials of alloy steel for machine structural use of JIS G 4053, etc. These steel materials are generally hot rolled to rod shapes or wire shapes, then spheroid annealed and further drawn and cold drawn repeatedly, then formed into part shapes by cold forging and adjusted to a predetermined strength or hardness by quenching and tempering and other heat treatment.

A steel material for machine structural use etc. includes a relatively large amount of carbon (0.20 to 0.40 mass % or so), so can be used for high strength parts by thermal refining. However, steel material for machine structural use etc. is high in strength as a forged material, so unless softening the steel material by spheroidization annealing and cold drawing, die wear and fracture easily occur at the time of cold forging in forming the part and, further, the part fractures. Due to this, due to the concern over such problems in manufacture, the steel material for machine structural use etc. is adjusted in strength etc. by softening the steel material.

In particular, in recent years, parts have tended to be made higher in strength and part shapes have tended to become more complicated. For this reason, for the purpose of softening a steel material, which has been quenched and tempered to obtain high strength, before cold forging, measures such as prolonging the time of spheroidization annealing and repeating the spheroidization annealing and cold drawing have been taken.

However, if adopting these measures, not only do the personnel costs, capital costs, and other costs swell, but also the energy loss becomes greater. For this reason, development of a steel material obtained by omitting spheroidization annealing (and cold drawing) or performing these in a shorter time period has been demanded.

With such a background, for the purpose of eliminating or shortening the time period of the spheroidization annealing, boron steel has been proposed reducing the contents of C, Cr, Mn, and other alloy elements to reduce the strength of the rolled wire rod forming the forging material and making up for the reduction in the hardenability due to the reduction in the alloy elements by the addition of B (boron). Numerous improvements have been made.

Boron steel exhibits a high hardenability. Sufficient hardenability can be secured even without adding Cr, Mo, and other alloy elements. Further, the cost can also be kept low. For this reason, boron steel has widely spread in use in recent years, but to form a part shape by cold forging and obtain a high strength part given a tensile strength of 1000 MPa or more after quenching and tempering, it is necessary to also overcome the problem of hydrogen embrittlement.

For example, Japanese Patent No. 3443285, Japanese Patent No. 5486634, and Japanese Unexamined Patent Publication No. 9-104945 respectively disclose a "hot rolled steel material for cold forging use excellent in crystal grain coarsening prevention characteristic and cold forgeability and method of production of the same", "steel for machine structural use for cold working and method of production of the same", and "steel for high strength bolt use excellent in cold workability and delayed fracture resistance, method of production of high strength bolt, and high strength bolt".

That is, Japanese Patent No. 3443285 discloses a hot rolled steel material for cold forging use excellent in crystal grain coarsening prevention characteristic and cold forgeability containing C: 0.10 to 0.60%, Si: 0.50% or less, Mn: 0.30 to 2.00%, P: 0.025% or less, S: 0.025% or less, Cr: 0.25% or less, B: 0.0003 to 0.0050%, N: 0.0050% or less, and Ti: 0.020 to 0.100%, having a balance of Fe and unavoidable impurities, and having 20/100 $\mu m^2$ or more of TiC or Ti(CN) of a diameter of 0.2 μm or less in the steel matrix and a method of production of the same.

Further, Japanese Patent No. 5486634 discloses steel for machine structural use for cold working containing, by mass %, C: 0.2 to 0.6%, Si: 0.01 to 0.5%, Mn: 0.2 to 1.5%, P: 0.03% or less, S: 0.01 to 0.05%, Al: 0.01 to 0.1%, N: 0.015% or less, and Cr: over 0.5% to 2.0%, having a balance of iron and unavoidable impurities, having a metal structure of pearlite and pro-eutectoid ferrite, having a total area rate of pearlite and pro-eutectoid ferrite to the entire structure of 90% or more, having an area rate A of pro-eutectoid ferrite of a relationship of A>Ae with Ae expressed by $Ae=(0.8-Ceq)\times 96.75$ (however, $Ceq=[C]+0.1\times[Si]+0.06\times[Mn]+0.11\times[Cr]$, [(element name)] meaning content of elements (mass %)) and having a mean particle size of pro-eutectoid ferrite and ferrite in the pearlite of 15 to 25 μm and able to realize sufficient softening by normal spheroidization and a method of production of the same.

Furthermore, Japanese Unexamined Patent Publication No. 9-104945 discloses steel for high strength bolt use excellent in cold workability and delayed fracture resistance comprised of, by mass %, C: 0.15 to 0.35%, Si: 0.1% or less, Mn: 0.3 to 1.3%, P: 0.01% or less, S: 0.01% or less, Cr: less than 0.5%, Ti: 0.01 to 0.10%, Al: 0.01 to 0.05%, B: 0.0005 to 0.003%, and a balance of Fe and unavoidable impurities and satisfying the following formula $0.50\leq[C]+0.15[Si]+0.2[Mn]+0.11[Cr]\leq 0.60$.

SUMMARY

Technical Problem

According to the art disclosed in Japanese Patent No. 3443285, the hardness of a rolled steel material can be reduced, so the material can be cold forged at low cost and, further, a crystal grain coarsening prevention characteristic at the time of heating for quenching can be provided. However, the content of Cr in the steel is low, so the hardenability is low and there are limits to raising the strength of a part. An over 1000 MPa high strength part has problems in hydrogen embrittlement resistance.

Further, the steel for machine structural use for cold working disclosed in Japanese Patent No. 5486634 can be softened by normal spheroidization annealing and can be applied to a high strength part. However, the balance of amount of addition of the chemical constituents in the steel is not optimized. Further, the ferrite fraction of the structure of the rolled steel material is substantially small. For this reason, if using a steel material as product rolled or in a state spheroid annealed for a short time at the time of cold forging a part, fractures are liable to occur and low cost manufacture of parts is liable to become impossible.

Furthermore, the art disclosed in Japanese Unexamined Patent Publication No. 9-104945 prescribes a lower limit and upper limit of the total amount of C, Si, Mn, and Cr to obtain a strength of a rolled material not having a detrimental effect on the cold workability and a strength of a rolled material by which a desired strength is obtained after thermal refining. However, the amount of Cr is low and the hardenability is low, so there is a problem in the hydrogen embrittlement resistance as an over 1000 MPa high strength part.

The present invention was made in consideration of the above situation and has as its object to provide rolled wire rod effectively suppressing fracturing at the time of cold forging and excellent in hydrogen embrittlement resistance after quenching and tempering following spheroidization annealing even without spheroidization annealing before cold forging or even if shortening the time period of spheroidization annealing.

Solution to Problem

The inventors engaged in various studies for solving the above problem. As a result, the inventors obtained the discoveries (a) to (e):

(a) To be able to secure cold forgeability to an extent enabling a part to be shaped even if eliminating the spheroidization annealing or shortening the time period, the internal structure other than at the surface layer part where a decarburized layer may be formed must be a mixed structure of ferrite and pearlite of an area rate of 95% or more. Further, the ferrite fraction must exceed 40%.

(b) Even with the same mixed structure of ferrite and pearlite, by refining the inclusions present near the surface of the rolled wire rod and reducing the grown inclusions, the cold forgeability can be improved and due to this a more complicated part can be formed. Further, by refining and reducing the inclusions, the hydrogen embrittlement resistance after quenching and tempering is improved.

(c) C, Si, Mn, Cr, and other added elements mainly have an effect on the strength of the rolled wire rod. Further, Mn, Ti, N, S, and other added elements have an effect on the composition or form of the inclusions unavoidably contained in the rolled wire rod. To provide excellent cold forgeability and the hardenability and hydrogen embrittlement resistance required for use as a cold forged part, it is necessary to sufficiently consider the balance of these two types of added elements. Further, to provide the above cold forgeability etc., furthermore it is necessary to perform primary rolling with a rolling ratio of 6 or more after high temperature heating before product rolling or control the manufacturing conditions of the steel material such as the temperature of the finish rolling after that. Due to this, it is possible to obtain rolled wire rod able to realize excellent cold forgeability even if eliminating spheroidization annealing or shortening the time period predicated on securing hardenability of a level enabling use as a cold forged part.

(d) Specifically, a steel ingot or cast slab is produced from molten steel with a predetermined balance of chemical constituents, then is heated to a high temperature of 1280° C. or more at a stage before the product rolling, soaked for a time of at least 30 min or more, then immediately primary rolled by a rolling ratio of 6 or more and cooled. Due to this, part of the coarse carbonitrides or carbides containing Ti formed at the time of solidification and coarse sulfides containing Ti or Mn dissolve once in the steel. The coarse sulfides are split by primary rolling at a high temperature, then finely reprecipitate in the subsequent cooling process. Therefore, coarse sulfides having a detrimental effect on the cold forgeability are suppressed, the reprecipitated fine carbonitrides and carbides act as pinning grains at the time of heating at the time of hot product rolling performed after that, and prevention of coarsening and growth of the austenite grains is contributed to. As a result, the ferrite precipitated at the time of cooling after product rolling becomes finer and the ferrite fraction becomes higher and in turn the structure described in (a) can be obtained.

(e) The steel slab primary rolled after high temperature heating in this way is reheated, then is product rolled hot to wire rod of a predetermined diameter. However, the final finish rolling at the product rolling is preferably performed at a 5 to 15/sec working speed and a 750 to 850° C. temperature range. By managing the working speed and temperature range of the finish rolling, the austenite grains before ferrite transformation becomes finer and the ferrite fraction becomes higher, so it is possible to obtain the structure described in (a). If the finish rolling temperature is less than 750° C., the ferrite grains become too fine and the strength of the rolled wire rod is raised and the cold forgeability deteriorates, while if the finish rolling temperature is over 850° C., it is not possible to obtain the structure described in (a). Note that, the heating temperature at the time of product rolling is preferably 1050° C. or less.

The rolled wire rod obtained based on the findings of the above (a) to (e) has an internal structure of a total of ferrite and pearlite of an area rate of 95% or more and a ferrite fraction of over 40%. Further, in this rolled wire rod, the mean area of sulfides present in a range from the surface to D/8 (D indicates the diameter (mm) of the rolled wire rod) is 6 $\mu m^2$ or less. Furthermore, in this rolled wire rod, the mean aspect ratio of the sulfides is 5 or less. For this reason, this rolled wire rod is a wire rod with a small presence of coarsely grown sulfides.

As a result, the rolled wire rod has sufficient cold forgeability and can secure hardenability even if omitting the spheroidization annealing or shortening the time period, so can be suitably used as a cold forged part and can be made a wire rod excellent in hydrogen embrittlement resistance after quenching and tempering as well.

Note that if heating to a temperature over the $Ac_3$ point for hardening after cold forging, sometimes abnormal grain growth occurs where part of the austenite crystal grains abnormally grow larger and becomes a factor behind variation in part strength. However, the rolled wire rod in the present invention is excellent in coarsening resistance. Even if heating to a temperature over the $Ac_3$ point after cold forging, it is possible to suppress abnormal grain growth of the crystal grains.

The present invention was completed based on the above discovery. Its gist is a rolled wire rod shown in the following (1) to (3):

(1) Rolled wire rod comprising, by mass %,

C: 0.20% to less than 0.40%,

Mn: 0.10% to less than 0.40%,

S: less than 0.020%,

P: less than 0.020%,

Cr: 0.70% to 1.60%,

Al: 0.005% to 0.060%,

Ti: 0.010% to 0.080%,

B: 0.0003% to 0.0040%, and

N: 0.0020% to 0.0080% and having a balance of Fe and impurities, wherein if the contents of Ti, N, and S (mass %) are respectively [Ti], [N], and [S], if [S]≤0.0010, [Ti] is (4.5×[S]+3.4×[N]) or more and (0.008+3.4×[N]) or less, while if [S]≤0.0010, [Ti] is (4.5×[S]+3.4×[N]) or more and (8.0×[S]+3.4×[N]) or less, the internal structure is a mixed structure of ferrite and pearlite with an area rate of a ferrite fraction of 40% or more, a mean area of sulfides present in a range from a surface to a D/8 position is 6 $\mu m^2$ or less in the case of a diameter of D (mm) in a cross-section at a plane including the axial direction, and a mean aspect ratio of the sulfides is 5 or less.

(2) The rolled wire rod according to (1) comprising, instead of part of the Fe, by mass %, at least one type of Si: 0% to less than 0.40% and Nb: 0% to 0.050%.

(3) The rolled wire rod according to (1) or (2) comprising, instead of part of the Fe, by mass %, at least one type of Cu: 0.50% or less, Ni: 0.30% or less, Mo: 0.05% or less, and V: 0.05% or less.

(4) The rolled wire rod according to any one of (1) to (3) comprising, instead of part of the Fe, by mass %, at least one type of Zr: 0.05% or less, Ca: 0.005% or less, and Mg: 0.005% or less.

Advantageous Effects of Invention

By using the rolled wire rod of the present invention as a material, it is possible to form a part by cold forging even if eliminating or shortening the time of spheroidization annealing, abnormal grain growth of the crystal grains is suppressed even if heating to the austenite region at the time of quenching, and use is possible as a cold forged part excellent in hydrogen embrittlement resistance after quenching and tempering.

DESCRIPTION OF EMBODIMENTS

Figure 1:
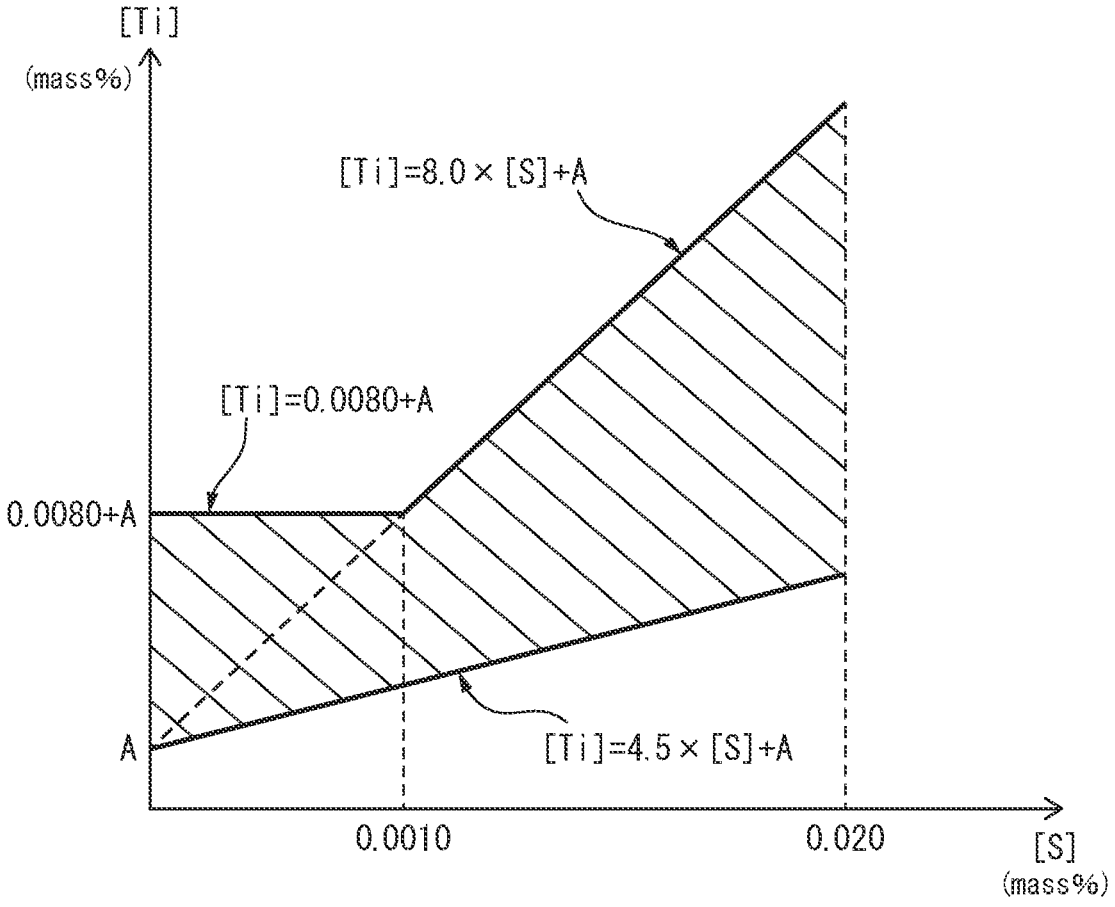
FIG. 1 is a view showing a region where a relationship of [Ti] and [S] of the present embodiment is satisfied.

Below, rolled wire rod of the present embodiment will be explained in detail. Note that the "rolled wire rod" of the present embodiment means a rod shaped or wire shaped rolled steel material with a diameter of 5 to 25 mm or so. Further, the symbol "%" of the contents of the elements shown below mean "mass %".

(A) Regarding Chemical Constituents

C: 0.20% to less than 0.40%

C is an element strengthening steel and must be contained in 0.20% or more. On the other hand, if the content of C is 0.40% or more, the cold forgeability falls. Therefore, the content of C was made 0.20% to less than 0.40%. Furthermore, if desiring to raise the quenching hardness of the cold forged part, it is preferable to make the content of C 0.24% or more. Furthermore, if desiring to raise the cold forgeability, it is preferable to make it 0.35% or less.

Mn: 0.10% to less than 0.40%

Mn is an element required for raising the hardenability, so the lower limit value was made 0.10%. However, if the content of Mn becomes 0.40% or more, at the time of cooling after finish rolling, the start temperature of ferrite transformation falls and the ferrite fraction falls. Furthermore, bainite is formed, so the cold forgeability falls. Therefore, the content of Mn has to be made less than 0.40%. Note that to raise the hardenability, Mn preferably is contained in 0.20% or more.

S: less than 0.020%

S is contained as an impurity. However, if the content of S becomes 0.020% or more, the sulfides contained in the steel grow coarsely in form and cause the cold forgeability to drop. The content of S is preferably less than 0.010%. Further, to obtain the form or size of sulfides excellent in cold forgeability, even if S is the same range of content, it must be included while considering the balance with Ti and N.

P: less than 0.020%

P is contained as an impurity. However, if the content of P becomes 0.020% or more, not only does the cold forgeability fall, but also P segregates at the grain boundaries at the time of heating to austenite and becomes a factor behind fracturing at the time of quenching. Further, it causes a drop in the hydrogen embrittlement resistance after quenching and tempering. For this reason, the content of P must be less than 0.020%. The content of P is preferably made less than 0.010%.

Cr: 0.70% to 1.60%

Cr, like Mn, is an element required for raising the hardenability. In the present invention, it must be contained in 0.70% or more. However, if the content of Cr is over 1.60%, the hardenability rises, but the start temperature of ferrite transformation at the time of cooling after finish rolling falls and the ferrite fraction falls. Furthermore, bainite is formed, so the cold forgeability falls. To stably obtain a high hardenability, the content of Cr is preferably made 0.80% or more. Including it in 0.90% or more is further preferable. On the other hand, if desiring to raise the cold forgeability more, the content of Cr is preferably made 1.50% or less, while making it 1.40% or less is more preferable.

Al: 0.005% to 0.060%

Al not only has a deoxidizing action, but also bonds with N to form AlN. Due to that pinning effect, it has the action of refining the austenite grains at the time of hot rolling and suppressing the formation of bainite. For this reason, Al must be contained in 0.005% or more. On the other hand, if the content of Al is over 0.060%, not only does that effect become saturated, but also coarse AlN is formed, so the cold forgeability falls. If desiring to further suppress the formation of bainite, the content of Al is preferably made 0.015% or more, more preferably 0.020% or more. Further, from the viewpoint of raising the cold forgeability, the content of Al is preferably 0.050% or less, more preferably 0.045% or less.

Ti: 0.010% to 0.080%

Ti bonds with N and C to form carbides, nitrides, or carbonitrides. Due to that pinning effect, it has the action of refining the austenite grains at the time of hot rolling, suppressing the formation of bainite in the cooling process after the finish rolling, and raising the ferrite fraction. Further, Ti also has the action of suppressing abnormal grain growth when heating to a temperature over the $Ac_3$ point for quenching after cold forging. Furthermore, Ti also has the action of reducing the N in solid solution in the steel to suppress the formation of BN and thereby enhance the effect of improvement of the hardenability by B. In addition, Ti also reacts with S to change the composition of sulfides and refine the sulfides and thereby has the effect of enhancing the cold forgeability and hydrogen embrittlement resistance, so must be added while considering the balance with N and S.

To obtain these effects, Ti must be included in 0.010% or more. To further obtain these effects, the content of Ti is preferably 0.030% or more, more preferably 0.060% or more. On the other hand, if included in over 0.080%, at the time of finish rolling, fine Ti carbides ends up precipitating and the ferrite phases are strengthened to cause deterioration of the cold forgeability, so the content of Ti is 0.070% or less. Note that, Ti forms carbides, nitrides, or carbonitrides and forms a solid solution in sulfides so has an effect on the form and size of the sulfides. For this reason, this contributes to the suppression of abnormal grain growth at the time of quenching and improvement of the cold forgeability and hydrogen embrittlement resistance. Therefore, even if the content of Ti is in the above range, it must be included while considering the balance with S and N.

B: 0.0003% to 0.0040%

B is effective for raising the hardenability of steel by addition in a fine amount. 0.0003% or more must be included. However, even if included in over 0.0040%, not only does the effect become saturated, but also the cold forgeability deteriorates. If desiring to further raise the hardenability, the content of B is preferably 0.0005% or more, more preferably 0.0010% or more. On the other hand, if further improving the cold forgeability, the content of B is preferably made 0.0030% or less, more preferably 0.0025% or less.

N: 0.0020% to 0.0080%

N bonds with Ti and Al to form nitrides and carbonitrides and has the effect of refining the austenite grains at the time of hot rolling and the effect of suppressing abnormal grain growth at the time of heating when quenching the cold forged part. However, the content of N must be determined while considering the balance with Ti—which affects the composition or form of sulfides. To obtain these effects, N must be included in 0.0020% or more. Preferably it is included in 0.0030% or more. However, even if excessively including N, not only are these effects saturated, but also it also bonds with B to form nitrides and ends up weakening the effect of improvement of hardenability by B, so the content of N must be made 0.0080% or less. To stably improve the hardenability, the content of N preferably is made less than 0.0070%, more preferably is made 0.0060% or less. Note that, N bonds with Ti to form nitrides or carbonitrides. For this reason, N affects the amount of Ti—which affects the form and size of sulfides. Therefore, N must be included while considering the balance with Ti and S.

In the present invention, as stated up to here, the balance of the elements of Ti, N, and S is important. In particular, if ([Ti]−3.4×[N]) is excessively small in ratio with [S], the effect of Ti dissolving in sulfides and refining the sulfides is not obtained and coarse sulfides easily become present. Behind this is the fact that in the present invention, to obtain a ferrite-pearlite structure suitable for cold forgeability, the content of Mn is low and Fe dissolves in the sulfides resulting in easy coarsening of the sulfides.

On the other hand, if ([Ti]−3.4×[N]) is excessively large in ratio with [S], fine Ti carbides precipitate in the ferrite, the strength of the ferrite is increased, and the cold forgeability is lowered.

By making the ([Ti]−3.4×[N]) a suitable amount in ratio with [S], the sulfides contained become compositions with dissolved Ti. As a result, the sulfides are refined and the base material is improved in cold forgeability. Further, even if heating to the austenite region at the time of quenching, abnormal grain growth of the crystal grains is suppressed and use as a cold forged part excellent in hydrogen embrittlement resistance after quenching and tempering is possible.

Based on this, if designating the contents (mass %) of Ti, N, and S in the rolled wire rod of the present embodiment respectively as [Ti], [N], and [S], these satisfy the following conditions:

if [S]≤0.0010, [Ti] is (4.5×[S]+3.4×[N]) or more and (0.008+3.4×[N]) or less and if [S]≥0010, [Ti] is (4.5×[S]+3.4×[N]) or more and (8.0×[S]+3.4×[N]) or less.

In this definition, the formula prescribing the upper limit of [Ti] changes at [S]=0.0010. The reason will be explained later.

The hatched part of FIG. 1 shows the region satisfying the above-mentioned relationship of [Ti], [S], and [N]. In FIG. 1, the value A shown by the ordinate is the value dependent on the above [N] (value of 3.4 times [N]). Specifically, it is a value fluctuating in the range from 0.0068 (mass %) to 0.0272 (mass %). Note that in the present invention, [N] is prescribed as 0.0020% to 0.0080%, so the value A becomes 0.0068 to 0.0272.

In the case of [S]≤0010, by [Ti] being (4.5×[S]+3.4×[N]) or more, the sulfides contained become compositions with dissolved Ti and the structure becomes finer, so cold forgeability is improved.

Further, in the case of [S]≥0.0010, by [Ti] being (8.0×[S]+3.4×[N]) or less, the amount of precipitation of fine Ti carbides is suppressed, the strength of the ferrite does not become excessively high, and a drop in cold forgeability can be prevented.

In the case of [S]≤0.0010 as well, in the same way as the case of [S]≥0.0010, by [Ti] being (4.5×[S]+3.4×[N]) or more, the sulfides contained become compositions with dissolved Ti and the structure becomes finer, so cold forgeability is improved.

As opposed to this, the upper limit of [Ti] in the case of [S]≤0010 is prescribed as (0.008+3.4×[N]). If [Ti] is in this range, the amount of fine Ti carbides precipitating inside the wire rod is small, the strength of the ferrite will not become excessively high, and a drop in the cold forgeability can be prevented.

Here, regarding the upper limit value of [Ti], the reason why the formula is divided into parts before and after [S]=0.0010 will be explained. As explained above, the upper limit value of [Ti] is restricted to suppress the amount of precipitation of fine Ti carbides and make the strength of the wire rod suitable. In the region where [Ti] is small, in particular in the region where [Ti] is (0.008+3.4×[N]) or less, the fine Ti carbides produced (regardless of the content of [S]) are small in amount and the effect on the wire rod hardness is small. In the region where [S] is relatively large, at the intersecting point of the formulas (8.0×[S]+3.4×[N]) and (0.008+3.4×[N]) prescribing the upper limit of [Ti], [S]=0.0010.

That is, in the range of [S]≤0.0010, even if [Ti] is (8.0×[S]+3.4×[N]) or more, if (0.008+3.4×[N]) or less, it is possible to produce rolled wire rod able to achieve the object of the present invention. For this reason, in the region of [S]≤0.0010, a provision different from the region of [S]≥0.0010 was introduced.

Further, the rolled wire rod according to the present embodiment is mainly used for a part imparting strength by quenching and tempering after cold forging. From this, to secure the hardenability of the part, the C, Mn, and Cr contained in the rolled wire rod preferably satisfy the following formula <1>:

$$[Mn]\times[Cr]>0.134\times(D/25.4-(0.50\times\sqrt{[C]}))/(0.50\times\sqrt{[C]}) \quad <1>$$

Here, in the formula, [Mn], [Cr], and [C] indicate the contents by mass % of the respective elements while D indicates the diameter (mm) of the rolled wire rod.

Here, the left side of formula <1> is a value shown by the product of the mass % of Mn and Cr contained in the steel and a parameter required for securing the hardenability sought as a high strength, cold forged part.

As opposed to this, the right side of formula <1> is a parameter showing the relationship between D and [C] affecting the fraction of the martensite obtained at the D/2 (mm) position from the surface of the center part of the rolled wire rod in the case of heating a rolled wire rod of a diameter of D (mm) up to a temperature of the $Ac_3$ point or more and quenching it by oil cooling.

Further, to secure sufficient hardenability as a high strength cold forged part, it is preferable that the value of the left side in formula <1> be larger than the value of the right side.

Note that, the balance in the rolled wire rod according to the present embodiment comprises "Fe and impurities". Here, "impurities" are constituents not intentionally included in the rolled wire rods. They indicate impurities entering from the ore and scrap used as the raw materials when industrially producing ferrous metal materials or impurities entering due to the manufacturing environment. For example, oxygen is an impurity. To suppress the formation of coarse oxides and keep the cold forgeability from deteriorating, it is preferable to suppress the content to 0.0030% or less, it is more preferable to suppress the content to 0.0020% or less, and it is extremely preferable to suppress the content to 0.0015% or less.

Next, the wire rod according to the present embodiment may contain, instead of part of Fe of the balance, in accordance with need, at least one type of element selected from Si, Nb, Cu, Ni, Mo, V, Zr, Ca, and Mg. Below, the contents of the optionally added elements of Nb, Cu, Ni, Mo, V, Zr, Ca, and Mg and the reasons for setting the contents will be explained in detail.

Si: 0% to less than 0.40%

To lower the tensile strength of the rolled wire rod in the hot rolled state, the smaller content of Si is better. However, Si strengthens the ferrite by solution strengthening, so may be included if desiring to raise the quenching hardness of the cold forged part. In this case, the content of Si has to be made less than 0.40%. If the content of Si is 0.40% or more, the cold forgeability falls. If desiring to raise the cold forgeability, the content of Si is preferably made less than 0.30%, more preferably is made less than 0.20%.

Nb: 0% to 0.050%

Nb bonds with C and N to form carbides, nitrides, or carbonitrides. Due to the pinning effects of these, it refines the austenite grains at the time of hot rolling, so has the action of suppressing the formation of bainite in the cooling process after finish rolling and raising the ferrite fraction. Further, carbides, nitrides, and carbonitrides of Nb suppress abnormal grain growth of crystal grains at the time of heating when quenching a cold forged part. In the present embodiment, it is possible to improve the ferrite fraction and suppress abnormal grain growth of crystal grains even without adding Nb. However, if desiring to reliably realize these effects, it is effective to add Nb. That is, to reliably obtain these effects, Nb is preferably included in 0.003% or more, more preferably included in 0.005% or more, extremely preferably included in 0.010% or more. On the other hand, if including Nb over 0.050%, not only are these effects saturated, but also the cold forgeability of the rolled wire rod is liable to end up being lowered. For this reason, the content of Nb is preferably 0.040% or less, more preferably 0.030% or less.

Cu: 0.50% or less

Cu is an element enhancing the hardenability and may also be included. However, if the content of Cu is over 0.50%, the hardenability becomes too high, bainite ends up being produced after finish rolling, and a drop in the cold forgeability of the rolled wire rod is invited. Therefore, the content of Cu is preferably 0.50% or less, more preferably 0.30% or less, extremely preferably 0.20% or less. Note that, to stably obtain the above-mentioned effect of addition of Cu, the content of Cu is preferably 0.03% or more, more preferably 0.05% or more.

Ni: 0.30% or less

Ni is an element enhancing the hardenability and may also be included. However, if the content of Ni is over 0.30%, not only does the effect become saturated, but also the hardenability becomes too high, bainite ends up being produced after finish rolling, and a drop in the cold forgeability is invited. Therefore, the content of Ni is preferably 0.30% or less, more preferably 0.20% or less, extremely preferably 0.10% or less. Note that, to stably obtain the above-mentioned effect of Ni, the content of Ni is preferably 0.01% or more, more preferably 0.03% or more.

Mo: 0.05% or less

Mo is an element strengthening steel by solution strengthening. It greatly improves the hardenability of steel. Mo may be included for this purpose. However, if the content of Mo exceeds 0.05%, bainite and martensite are produced after finish rolling and a drop in the cold forgeability is invited. Therefore, the content of Mo is preferably 0.05% or less, more preferably 0.03% or less, extremely preferably 0.02% or less. Note that to stably obtain the above-mentioned effect of Mo, the content of Mo is preferably 0.005% or more.

V: 0.05% or less

V bonds with C and N to form carbides, nitrides, and carbonitrides. By addition in a fine amount, it also has the action of improving the hardenability of the steel. For this reason, V may also be included. However, if the content of V exceeds 0.05%, the precipitating carbides and carbonitrides cause the strength of the rolled wire rod to increase and invite a drop in cold forgeability. Therefore, the content of V is preferably 0.05% or less. From the viewpoint of improving the cold forgeability, the content of V is more preferably 0.03% or less, extremely preferably 0.02% or less. Note that, to stably obtain the above-mentioned effect of V, the content of V is preferably 0.005% or more.

Zr: 0.05% or less

Zr also has the action of improving the hardenability of steel by addition in a fine amount. It is also possible to add a fine amount of Zr for that purpose. However, if the content of Zr exceeds 0.05%, coarse nitrides are formed and the cold forgeability is caused to fall. Therefore, the content of Zr is preferably 0.05% or less. From the viewpoint of improving the cold forgeability, the amount of Zr is more preferably 0.03% or less, extremely preferably 0.02% or less. Note that, to stably obtain the above-mentioned effect of Zr, the content of Zr is preferably 0.003% or more.

Ca: 0.005% or less

Ca bonds with S to form sulfides and acts as nuclei for formation of MnS, so Ca has the action of causing MnS to finely disperse. By making MnS finely disperse in this way, ferrite precipitates using MnS as the nuclei of formation at the time of cooling after finish rolling, so Ca has the effect of improving the ferrite fraction. For this reason, Ca may also be included. However, if the content of Ca exceeds 0.005%, the above-mentioned effect is saturated and further Ca reacts with the oxygen in the steel together with Al to form oxides which become coarse and invite a drop in cold forgeability. Therefore, the content of Ca is preferably 0.005% or less, more preferably 0.003% or less, extremely preferably 0.002% or less. Note that to stably obtain the above-mentioned effect of Ca, the content of Ca is preferably 0.0005% or more.

Mg: 0.005% or less

Mg bonds with S to form sulfides and has an action as nuclei for formation of MnS, so Mg has the effect of causing fine dispersion of MnS. By making MnS finely disperse in this way, ferrite precipitates using MnS as the nuclei of formation at the time of cooling after finish rolling, so Mg has the effect of improving the ferrite fraction. For this reason, Mg may also be included. However, if the content of Mg exceeds 0.005%, the above-mentioned effect is saturated. Further, Mg is poor in yield of addition and causes deterioration of the manufacturing costs, so is included. Therefore, the content of Mg is preferably 0.005% or less, more preferably 0.003% or less, extremely preferably 0.002% or less. Note that, to obtain the above-mentioned effect of Mg, the content of Mg is preferably 0.0005% or more.

(B) Regarding Internal Structure of Rolled Wire Rod

The rolled wire rod according to the present embodiment is excellent in cold forgeability. Even if eliminating spheroidization annealing after product rolling, which used to take about 20 hours, or reducing the time of that treatment to about half, no drop in die lifetime at the time of cold forging, fracture of the shaped part, etc. occurs. This is so as to control the metal structure of the rolled wire rod to a form suitable for cold forging by controlling not only the adjusted chemical constituents of the steel, but also the manufacturing conditions of the rolled wire rod.

Specifically, in the rolled wire rod according to the present embodiment, the internal structure minus the surface layer part where a decarbonized layer may be formed is a mixed structure of an area rate of 95% or more of ferrite and pearlite where the fraction of the ferrite structure is 40% or more. Here, the ferrite in the present embodiment does not include ferrite between the lamellar cementite contained in the pearlite. Further, the mixed structure of ferrite and pearlite being 95% or more of the total in area rate means the total of martensite and bainite being less than 5%. To obtain good cold forgeability, as mentioned above, the mixed structure of ferrite and pearlite must be made an area rate of 95% or more. Making it 100% is more preferable.

If the ferrite fraction is less than 40%, the problems arise that good cold forgeability cannot be secured, fractures form in the parts at the time of formation, and the deformation resistance of the rolled wire rod is high, so the die lifetime becomes shorter. The ferrite fraction is preferably 45% or more, extremely preferably 50% or more.

Further, a ferrite fraction being 60% or less is preferable for the reason that it is possible to suppress forging defects due to seizure during cold forging. The ferrite fraction is more preferably 55% or less.

(C) Regarding Form of Inclusions in Wire Rod

The rolled wire rod according to the present embodiment is excellent in cold forgeability. At the time of cold forging, no drop in die lifetime or fractures of the shaped parts etc. occur. Further, even if heating to the austenite region for the purpose of quenching the wire rod, abnormal grain growth of the crystal grains is suppressed and, furthermore, the hydrogen embrittlement resistance after tempering is also excellent. This is because not only are the adjusted chemical constituents of the steel and metal structure of the rolled wire rod controlled, but also, furthermore, the sulfides included near the surface of the rolled wire rod are refined in form and sulfides elongated in the rolling direction are reduced.

Specifically, in the wire rod according to the present embodiment, by rectification of the chemical constituents and rolling conditions, the internal structure of the rolled wire rod is made a mixed structure of ferrite and pearlite with a ferrite fraction of 40% or more, and the cold forgeability is improved. In particular, to obtain a mixed structure of ferrite and pearlite suitable for cold forgeability, the content of Mn is limited. In such a low Mn system of constituents, the sulfides contained in the cast slab become sulfides containing Fe in solid solution, so coarsening easily occurs. For this reason, by including Ti, N, and S in a good balance as described above, it is possible to keep Ti from forming solid solutions in sulfides and keep sulfides from coarsening.

Furthermore, the coarse sulfides remaining at the stage of the cast slab even so are split by heating to a high temperature of 1280° C. or more at a stage before product rolling, securing a soaking time of at least 30 minutes or more, then immediately performing primary rolling by a rolling ratio of 6 or more. Further, part of the coarse sulfides forming solid solutions by the high temperature heating finely reprecipitate in the subsequent cooling process. Due to these treatments, it is possible to suppress coarse sulfides which would have a detrimental effect on cold forgeability or hydrogen embrittlement resistance. In particular, when forming a cold forged part from the rolled wire rod, sulfides present in the range from the surface to D/8 (D: diameter of rolled wire rod) induce fracturing and hydrogen embrittlement due to cold forging. For this reason, in the present embodiment, in the cross-section including the axial direction of the rolled wire rod, the mean area of the sulfides present in the range from the surface to D/8 is made 6 $\mu m^2$ or less and, furthermore, the mean aspect ratio of the sulfides is made 5 or less.

If the mean area of the sulfides becomes larger than 6 $\mu m^2$, regardless of the form, stress concentrates in the vicinity of the coarse sulfides and becomes the starting point of fracturing at the time of cold forging. Further, if the mean area of the sulfides becomes larger than 6 $\mu m^2$, the hydrogen embrittlement resistance after quenching and tempering also deteriorates. For this reason, in the rolled wire rod according to the present embodiment, the mean area of sulfides present in the range from the surface to D/8 is made 6 $\mu m^2$ or less. Note that, the smaller the mean area of the sulfides, the better.

Further, in the rolled wire rod according to the present embodiment, regardless of the size of the sulfides, the mean value of the aspect ratio of the radio of the maximum length and maximum width of the sulfides is made smaller than 5. Due to this, stretched sulfides are kept from becoming starting points of fracturing. Note that, the smaller the mean aspect ratio of these sulfides, the better.

(D) Regarding Manufacturing Process of Wire Rod

In the present embodiment, by controlling not only the chemical constituents of the rolled wire rod, but also the manufacturing conditions of the rolled wire rod, it is possible to control the structure as product rolled and the form of the inclusions and provide rolled wire rod able to be suitably used as a cold forged part. Below, a method of production for controlling the structure after product rolling and the form of the inclusions will be illustrated. Note that, if the chemical constituents of the rolled wire rod, the form of the structure, and the form of the inclusions are within the above-mentioned ranges of the present invention, the effect of the present invention will not be harmed. Note that, even if rolled wire rod with chemical constituents and form of structure within the ranges of the present invention is obtained by a manufacturing process other than the following manufacturing process, the rolled wire rod is included in the present invention.

Specifically, the C, Mn, Cr, Ti, S, N, and other chemical constituents are adjusted and the steel ingots or cast slabs smelted and cast by the converter or electric furnace etc. are bloomed to obtain steel slabs of material for product rolling. To obtain the rolled wire rod of the present invention, at the stage of blooming the steel ingots or cast slabs, the steel has to be heated to a high temperature of at least 1280° C. or more, soaked for 30 min or more, then immediately primary rolled by a rolling ratio of 6 or more, then cooled. This is so as to split the coarse sulfides which were formed at the cast slab stage by primary rolling, cause part of the coarse sulfides to dissolve by high temperature heating, then cause them to finely reprecipitate in the subsequent cooling process. Further, this is also to cause the coarse Ti carbonitrides, Ti carbides, and other carbonitrides and carbides formed in the cast slab due to solidification to dissolve in the steel once by high temperature heating and finely reprecipitate in the cooling process.

After that, the steel slab obtained by blooming is reheated and product rolled hot to a predetermined diameter of wire rod, but the heating temperature at the time of product rolling at this time is made 1050° C. or less. This is because if making the heating temperature at the time of product rolling too high, the fine carbonitrides or carbides which reprecipitated due to the above-mentioned high temperature heat treatment again dissolve and, along with ferrite transformation at the time of cooling after product rolling, these nitrides and carbides coherently precipitate. If such coherent precipitation occurs, the strength after product rolling ends up being raised and the cold forgeability ends up falling. Note that, the Ti carbonitrides, Ti carbides, and other carbonitrides and carbides not dissolved due to heating at the time of product rolling do not have any effect on the strength after product rolling, do not cause deterioration of the cold forgeability, and have the effect of suppressing abnormal grain growth of the crystal grains even if heating to the $Ac_3$ point or more at the time of quenching after cold forging.

Furthermore, due to the finish rolling of the product rolling, the steel is finally finished to a predetermined diameter of wire rod. The finish rolling is rolling performed by a finish rolling mill train in the fmal process of product rolling. It is performed by a working speed Z of 5 to 15/sec in a range of rolling temperature of 750 to 850° C. The working speed Z is a value found by the following formula <2> from the cross-sectional reduction rate of the wire rod due to finish rolling and the finish rolling time. Further, the finish rolling temperature may be obtained by measuring the temperature at the exit side of the finish rolling mill train using an infrared radiation thermometer etc.

$$Z=-\ln(1-R)/t \quad <2>$$

where, R is the rate of reduction of cross-section of wire rod by finish rolling, while "t" indicates the finish rolling time (sec).

Further, the rate of reduction of cross-section R is found by $R=(A_0-A)/A_0$ from the cross-sectional area $A_0$ before finish rolling of the rolled wire rod and the cross-sectional area A after finish rolling.

The finish rolling time "t" is the time during which the rolled wire rod passes through a finish rolling mill train. This can be found by dividing the distance from the first rolling mill to the last rolling mill of the finish rolling mill train by the mean conveyance speed of the rolled wire rod.

In the case where the temperature of the finish rolling is less than 750° C. or the case where the working speed of the finish rolling is over 15/sec, the ferrite transformation from the nonrecrystallized austenite grains to ferrite starts, so the structure after cooling becomes too fine, the strength rises, and the cold forgeability deteriorates. As opposed to this, in the case where the temperature of the finish rolling is over 850° C. or the case where the working speed is less than 5/sec, the recrystallized austenite grains become coarser and the start temperature of the ferrite transformation becomes lower, so the ferrite fraction of the structure after cooling becomes smaller and the cold forgeability deteriorates. Note that after the finish rolling is completed, the range of the cooling speed until the surface temperature of the rolled wire rod becomes 500° C. is preferably made 0.2 to 5° C./sec.

EXAMPLES

Below, examples will be used to explain the present invention specifically.

In the present invention, even with steel of the same chemical constituents, depending on the manufacturing process, the requirements of the present invention may not be satisfied. For this reason, first, steels of substantially the same chemical constituents were used to produce rolled wire rods by different conditions to investigate the effect of the present invention. Further, steels of different chemical constituents were used to produce rolled wire rods by the same conditions to investigate the effect of the present invention.

First, for examples of using steels with substantially the same chemical constituents, the constituents shown in Table 1 were employed and processed under the conditions shown in the table (primary rolling heating temperature, primary rolling reduction ratio, wire rod rolling heating temperature, and finish rolling temperature) to obtain bloomed steel slabs. These were product rolled to predetermined diameters of wire rods from the steel slabs to obtain rolled wire rods (Invention Example A0 and Comparative Examples A1 to A6). Note that in Table 1, the indication "-" means the content of the element is of the impurity level and that the element can be judged to be substantially not contained.

TABLE 1

| | No | C | Si | Mn | P | S | Cr | Al | Ti | N | B | Nb |
|---|---|---|---|---|---|---|---|---|---|---|---|---|
| Inv. ex. | A0 | 0.30 | 0.05 | 0.30 | 0.010 | 0.007 | 0.99 | 0.033 | 0.061 | 0.0038 | 0.0018 | — |
| Comp. ex. | A1 | 0.30 | 0.05 | 0.29 | 0.010 | 0.007 | 1.00 | 0.032 | 0.060 | 0.0036 | 0.0016 | — |
| | A2 | 0.30 | 0.04 | 0.30 | 0.010 | 0.008 | 1.00 | 0.035 | 0.061 | 0.0034 | 0.0015 | — |
| | A3 | 0.30 | 0.05 | 0.30 | 0.010 | 0.007 | 0.99 | 0.033 | 0.061 | 0.0038 | 0.0018 | — |
| | A4 | 0.30 | 0.05 | 0.30 | 0.010 | 0.007 | 0.99 | 0.033 | 0.061 | 0.0038 | 0.0018 | — |

TABLE 1-continued

| | | | | | | | | | | | | |
|---|---|---|---|---|---|---|---|---|---|---|---|---|
| | A5 | 0.30 | 0.05 | 0.31 | 0.010 | 0.007 | 1.00 | 0.031 | 0.060 | 0.0037 | 0.0016 | — |
| | A6 | 0.30 | 0.03 | 0.30 | 0.010 | 0.008 | 1.00 | 0.034 | 0.060 | 0.0033 | 0.0017 | — |

| | No | Cu | Ni | Mo | V | Ca | Mg | Zr | Primary rolling heating temp. (° C.) | Primary rolling reduction ratio | Wire rod rolling heating temp. (° C.) | Finish rolling temp. (° C.) |
|---|---|---|---|---|---|---|---|---|---|---|---|---|
| Inv. ex. | A0 | — | — | — | — | — | — | — | 1290 | 7.5 | 1040 | 820 |
| Comp. ex. | A1 | — | — | — | — | — | — | — | 1180 | 7.5 | 1040 | 820 |
| | A2 | — | — | — | — | — | — | — | 1290 | 2.4 | 1040 | 820 |
| | A3 | — | — | — | — | — | — | — | 1290 | 7.5 | 1050 | 950 |
| | A4 | — | — | — | — | — | — | — | 1290 | 7.5 | 1150 | 830 |
| | A5 | — | — | — | — | — | — | — | 1200 | 7.5 | 1040 | 820 |
| | A6 | — | — | — | — | — | — | — | 1290 | 5.3 | 1040 | 820 |

Next, for examples using steels with different chemical constituents, the constituents shown in Table 2 were employed and, at the stage of obtaining a steel slab from a cast slab, the primary rolling heating temperature was made 1280° C. or more and blooming was performed by a primary rolling reduction ratio of 6 or more. Further, using the obtained steel slab, product rolling (wire rod rolling heating temperature: 1030 to 1050° C., finish rolling temperature: 750 to 850° C.) was performed to obtain rolled wire rod (Invention Examples 1 to 14 and Comparative Examples 15 to 25). Note that, in Table 2, the indication "-" means the content of that element is of the impurity level and that it can be judged that the element is substantially not included. Note that, in Table 2, the indication "-" means the content of that element is of the impurity level and that it can be judged that the element is substantially not included.

Further, the indicator Y1 shown by the following formula is also shown in Table 2:

$$Y1=([Ti]-3.4\times[N])/[S] \quad \langle 1 \rangle$$

where, [Ti], [N], and [S] indicate the contents by mass % of the respective elements.

Y1 is a formula showing the balance of contents of Ti, N, and S contained in the steel. It is a parameter required for controlling the hardenability able to be used as a part for high strength cold forging use and the form and size of the sulfides present in the vicinity of the surface of the rolled steel material and for imparting excellent cold forgeability or suppressing abnormal grain growth at the time of quenching and imparting excellent hydrogen embrittlement resistance after quenching and tempering.

As explained above, in the rolled wire rod of the present embodiment, in the case where $[S]\geq 0.0010$, it is required that [Ti] be $(4.5\times[S]+3.4\times[N])$ or more and $(8.0\times[S]+3.4\times[N])$ or less. This requirement is expressed as $4.5\leq Y\leq 18.0$ using the indicator Y1.

In the case where $[S]\leq 0.0010$, the lower limit of [Ti] is $(4.5\times[S]+3.4\times[N])$. This is expressed as $4.5\leq Y1$. On the other hand, the upper limit of [Ti] in the range of $[S]\leq 0.0010$ is expressed as $(0.008+3.4\times[N])$ and does not depend on Y1. In this region, [Ti] is allowed to be in the region of $Y1>8.0$.

TABLE 2

| Ex. | No | C | Si | Mn | P | S | Cr | Al | Ti | N | B |
|---|---|---|---|---|---|---|---|---|---|---|---|
| Inv. ex. | 1 | 0.30 | 0.05 | 0.29 | 0.011 | 0.004 | 1.20 | 0.045 | 0.037 | 0.0046 | 0.0019 |
| | 2 | 0.32 | 0.04 | 0.39 | 0.010 | 0.006 | 1.00 | 0.040 | 0.061 | 0.0042 | 0.0021 |
| | 3 | 0.30 | 0.06 | 0.34 | 0.015 | 0.007 | 1.01 | 0.035 | 0.062 | 0.0045 | 0.0016 |
| | 4 | 0.33 | 0.04 | 0.28 | 0.009 | 0.006 | 1.15 | 0.036 | 0.045 | 0.0041 | 0.0018 |
| | 5 | 0.35 | 0.03 | 0.25 | 0.008 | 0.006 | 0.99 | 0.034 | 0.061 | 0.0041 | 0.0018 |
| | 6 | 0.23 | 0.04 | 0.38 | 0.012 | 0.004 | 1.02 | 0.033 | 0.041 | 0.0037 | 0.0020 |
| | 7 | 0.30 | 0.04 | 0.32 | 0.008 | 0.0007 | 1.00 | 0.035 | 0.015 | 0.0025 | 0.0015 |
| | 8 | 0.27 | 0.07 | 0.30 | 0.011 | 0.005 | 1.20 | 0.036 | 0.042 | 0.0038 | 0.0019 |
| | 9 | 0.30 | 0.08 | 0.30 | 0.009 | 0.008 | 1.01 | 0.035 | 0.063 | 0.0046 | 0.0020 |
| | 10 | 0.29 | 0.05 | 0.30 | 0.010 | 0.006 | 1.00 | 0.039 | 0.041 | 0.0031 | 0.0018 |
| | 11 | 0.26 | 0.04 | 0.28 | 0.009 | 0.004 | 1.02 | 0.035 | 0.041 | 0.0035 | 0.0010 |
| | 12 | 0.29 | 0.05 | 0.27 | 0.010 | 0.007 | 0.85 | 0.030 | 0.060 | 0.0049 | 0.0008 |
| | 13 | 0.30 | 0.06 | 0.29 | 0.006 | 0.004 | 1.01 | 0.031 | 0.035 | 0.0038 | 0.0015 |
| | 14 | 0.29 | 0.04 | 0.28 | 0.007 | 0.003 | 0.99 | 0.029 | 0.030 | 0.0039 | 0.0016 |
| Comp. ex. | 15 | 0.30 | 0.05 | 0.29 | 0.010 | 0.012 | 0.99 | 0.025 | 0.026 | 0.0040 | 0.0015 |
| | 16 | 0.28 | 0.04 | 0.30 | 0.009 | 0.006 | 0.98 | 0.030 | 0.073 | 0.0038 | 0.0016 |
| | 17 | 0.19 | 0.05 | 0.28 | 0.005 | 0.005 | 0.90 | 0.030 | 0.043 | 0.0039 | 0.0020 |
| | 18 | 0.43 | 0.06 | 0.38 | 0.009 | 0.006 | 0.99 | 0.030 | 0.045 | 0.0035 | 0.0019 |
| | 19 | 0.33 | 0.08 | 0.69 | 0.010 | 0.007 | 1.25 | 0.028 | 0.055 | 0.0045 | 0.0020 |
| | 20 | 0.30 | 0.07 | 0.38 | 0.010 | 0.031 | 1.00 | 0.030 | 0.065 | 0.0043 | 0.0018 |
| | 21 | 0.26 | 0.05 | 0.32 | 0.008 | 0.007 | 0.60 | 0.029 | 0.056 | 0.0045 | 0.0018 |
| | 22 | 0.30 | 0.75 | 0.32 | 0.010 | 0.005 | 1.00 | 0.028 | 0.036 | 0.0039 | 0.0014 |
| | 23 | 0.30 | 0.06 | 0.35 | 0.010 | 0.016 | 0.99 | 0.031 | 0.010 | 0.0029 | 0.0015 |
| | 24 | 0.29 | 0.06 | 0.39 | 0.008 | 0.007 | 0.95 | 0.030 | 0.047 | 0.0040 | 0.0002 |
| | 25 | 0.30 | 0.07 | 0.39 | 0.011 | 0.008 | 1.80 | 0.035 | 0.052 | 0.0039 | 0.0026 |

| Ex. | No | Nb | Cu | Ni | Mo | V | Ca | Mg | Zr | Y1 |
|---|---|---|---|---|---|---|---|---|---|---|
| Inv. ex. | 1 | — | — | — | — | — | — | — | — | 5.34 |
| | 2 | — | — | — | — | — | — | — | — | 7.79 |

TABLE 2-continued

| | | | | | | | | | | |
|---|---|---|---|---|---|---|---|---|---|---|
| | 3 | — | — | — | — | — | — | — | — | 6.67 |
| | 4 | — | — | — | — | — | — | — | — | 5.18 |
| | 5 | — | — | — | — | — | — | — | — | 7.84 |
| | 6 | — | — | — | — | — | — | — | — | 7.11 |
| | 7 | — | — | — | — | — | — | — | — | 9.29 |
| | 8 | 0.016 | — | — | — | — | — | — | — | 5.82 |
| | 9 | — | 0.15 | — | — | — | — | — | — | 5.92 |
| | 10 | — | 0.06 | 0.06 | — | — | — | — | — | 5.08 |
| | 11 | — | — | — | — | 0.02 | — | — | — | 7.28 |
| | 12 | — | — | — | 0.015 | — | — | — | — | 6.19 |
| | 13 | — | — | — | — | — | 0.0015 | — | — | 5.52 |
| | 14 | — | — | — | — | — | — | 0.0008 | 0.02 | 5.58 |
| Comp. ex. | 15 | — | — | — | — | — | — | — | — | 1.03 |
| | 16 | — | — | — | — | — | — | — | — | 10.01 |
| | 17 | — | — | — | — | — | — | — | — | 5.95 |
| | 18 | — | — | — | — | — | — | — | — | 5.52 |
| | 19 | — | — | — | — | — | — | — | — | 5.67 |
| | 20 | — | — | — | — | — | — | — | — | 1.63 |
| | 21 | — | — | — | — | — | — | — | — | 5.81 |
| | 22 | — | — | — | — | — | — | — | — | 4.55 |
| | 23 | — | — | — | — | — | — | — | — | 0.01 |
| | 24 | — | 0.05 | 0.02 | — | — | — | — | — | 4.77 |
| | 25 | — | 0.04 | 0.06 | — | — | — | — | — | 4.84 |

For Test No. A0 of the invention examples and Comparative Examples A1 to A6 of the chemical constituents shown in Table 1, rolled wire rods were fabricated as follows:

That is, in Invention Example A0 shown in Table 1, the cast slab was inserted into a 1290° C. furnace and soaked for 2 hours, then taken out from the furnace, then immediately bloomed to obtain a 162 mm square steel slab. At this time, the rolling ratio was 7.5.

On the other hand, in Comparative Example A1, the cast slab was inserted into a 1180° C. furnace and soaked for 2 hours, then taken out from the furnace, then immediately bloomed to obtain a 162 mm square steel slab. At this time, the rolling ratio was the same 7.5 as A0.

Further, in Comparative Example A5, the cast slab was inserted into a 1200° C. furnace and soaked for 2 hours, then taken out from the furnace, then immediately bloomed to obtain a 162 mm square steel slab. At this time, the rolling ratio was the same 7.5 as A0.

Further, in Comparative Examples A2 and A6, cast slabs with cross-sectional areas smaller than A0 and A1 were inserted into a 1290° C. furnace and soaked for 2 hours, then taken out from the furnace, then immediately bloomed to obtain 162 mm square steel slabs. At this time, the rolling ratio of Comparative Example A2 was 2.4, while the rolling ratio of Comparative Example A6 was 5.3.

Next, these steel slabs used as rolling materials were respectively heated to 1040° C., then were product rolled so as to become predetermined diameters at the finish rolling temperature of 820° C. to fabricate rolled wire rods. At this time, the working speed due to the finish rolling was in the range of 5 to 15/sec. The mean cooling speed from after the completion of the finish rolling to the end of the transformation was made 0.4° C./sec for controlled cooling.

In Comparative Examples A3 and A4, 162 mm square steel slabs obtained by the same chemical constituents as Invention Example A0 and bloomed under the same conditions as A0 were used as materials for product rolling. The heating temperatures before the product rolling and temperatures of the finish rolling were changed to prepare rolled wire rods. Specifically, in Comparative Example A3, heating was performed by a heating temperature of product rolling of 1050° C., then finish rolling was performed to give a predetermined diameter at a rolling temperature of 950° C. to prepare a rolled wire rod. At this time, the working speed due to the finish rolling was in the range of 5 to 15/sec, while the mean cooling speed after the end of finish rolling to the end of transformation was 0.4° C./sec.

In Comparative Example A4, heating was performed by a heating temperature of product rolling of 1150° C., then finish rolling was performed to give a predetermined diameter at a rolling temperature of 830° C. to prepare a rolled wire rod. At this time, the working speed due to the finish rolling was in the range of 5 to 15/sec, while the mean cooling speed after the end of finish rolling to the end of transformation was 0.4° C./sec.

In Comparative Example A6, a 162 mm square steel slab obtained by different chemical constituents from Invention Example A0 and bloomed under conditions different from A0 were used as materials for product rolling. The heating temperature before the product rolling and temperature of the finish rolling were changed to prepare a rolled wire rod. Specifically, Comparative Example A6 is an example of making the primary rolling temperature 1290° C. and making the primary rolling reduction ratio 5.3. Heating was performed by a heating temperature of product rolling of 1040° C., then finish rolling was performed to give a predetermined diameter at a rolling temperature of 820° C. to prepare a rolled wire rod. At this time, the working speed due to the finish rolling was in the range of 5 to 15/sec, while the mean cooling speed after the end of finish rolling to the end of transformation was 0.4° C./sec.

Next, for Test Nos. 1 to 14 of the invention examples and Comparative Examples 15 to 25 of the chemical constituents shown in Table 2, rolled wire rods were prepared in the following way.

That is, steel of each of the chemical constituents shown in Table 2 was smelted in a vacuum melting furnace. The smelted cast slab was inserted into a furnace heated to 1290° C. and soaked for 2 hours, then was taken out from the furnace and immediately bloomed to obtain a 140 mm square steel slab. This was used as the material for product rolling. At this time, the rolling ratio was 7.4. Next, the material for product rolling use was heated at 1030 to 1050° C., then the finish rolling temperature was adjusted to 750 to 850° C. and material was product rolled to obtain a wire rod of a diameter of 14 mm. At this time, the working speed by finish rolling was in each case a range of 5 to 15/sec. After the completion of the finish rolling, the mean cooling speed until the end of the transformation was 0.4 to 2° C./sec.

The above prepared rolled wire rods (Invention Example A0 and Comparative Examples A1 to A6 and Invention Examples 1 to 14 and Comparative Examples 15 to 25) were investigated for ferrite fraction (area %), form of inclusions (sulfide mean area ($\mu m^2$) and sulfide mean aspect ratio), cold forgeability (deformation resistance and fracturing), hydrogen embrittlement resistance, and presence of any abnormally coarse grains.

(Investigation of Microstructure of Rolled Wire Rod (Ferrite Fraction))

A rolled wire rod was cut to a length of 10 mm, then buried in resin so that the horizontal cross-section (cross-section perpendicular to axis of rolled wire rod) became the detected surface and then mirror polished. Next, a 3% nitric acid alcohol (Nital corrosive solution) was used to corrode the surface and bring out the microstructure. After that, at a position of D/4 from the surface of the rolled wire rod (D: diameter of rolled wire rod), using an optical microscope, photographs were taken of the microstructures of five fields by a magnification of 200× to identify the "phases". As a result, in the specimens of all of the examples and comparative examples, it was confirmed that an area rate of 95% or more was ferrite and pearlite. Furthermore, the ferrite area rate in each field was measured using image analysis software. The mean value of these was found and defined as the ferrite fraction in each example.

(Investigation of Form of Inclusions (Sulfide Mean Area ($\mu m^2$) and Sulfide Mean Aspect Ratio))

A rolled wire rod was cut to a length of 12 mm, then buried in resin so that the vertical cross-section of the rolled wire rod (plane including axis of wire rod) becomes the detected surface and then mirror polished. The detected surface was made parallel to the longitudinal direction of the rolled wire rod and the inclusions guessed to be sulfides present in a range from the surface of the rolled wire rod to the position of D/8 (D: diameter of rolled wire rod) were identified by a scan electron microscope (SEM). More specifically, any 100 observation regions in the detected surface were specified by a magnification of 500× in the range from the surface of the rolled wire rod to D/8. The area of each observation region was 254 μm×190 μm, while the total area of the observation regions was 4.8 $mm^2$. Further, the inclusions were specified based on the contrast judged by the reflected electron image of each observation region. The area and aspect ratio of each specified inclusion were measured. Finally, the mean values of these were found and used as the sulfide mean area (area %) and sulfide mean aspect ratio in each example. Note that, the identified inclusion was confirmed to be sulfides by energy dispersive X-ray spectrometry (EDS).

(Investigation of Cold Forgeability (Deformation Resistance and Fracturing))

The cold forgeability was evaluated by the deformation resistance at the time of cold working and the occurrence of fracturing of rolled wire rods. Specifically, a φ10×15 mmL rod was machined and cut out from a position corresponding to the center part of the rolled wire rod, was measured for deformation resistance by a cold compression test, and was investigated for the presence of any fracturing at the time of working. The test piece was compressed in stages until distorting (ε=2.2), measured for maximum load at the time of compression, and calculated for deformation resistance. Further, whether fractures formed at the surface of test pieces was judged visually.

Regarding the deformation resistance, the case where the deformation resistance calculated from the maximum load was less than 100 $kgf/mm^2$ (980 MPa) was evaluated as "Good", while the case where the deformation resistance was 100 $kgf/mm^2$ (980 MPa) or more was evaluated as "Not good". Regarding fracturing, the case where no fractures occurred at any part of the test piece was evaluated as "Good", while the case where fractures occurred at any part of the surface of the test piece was evaluated as "Not good". Further, the case where the evaluations of both of deformation resistance and fracturing were "Good" was evaluated overall as "Good", while the case where at least one of the deformation resistance and fracturing is failing was evaluated overall as "Not good".

(Investigation of Hydrogen Embrittlement Resistance)

Figure 2:
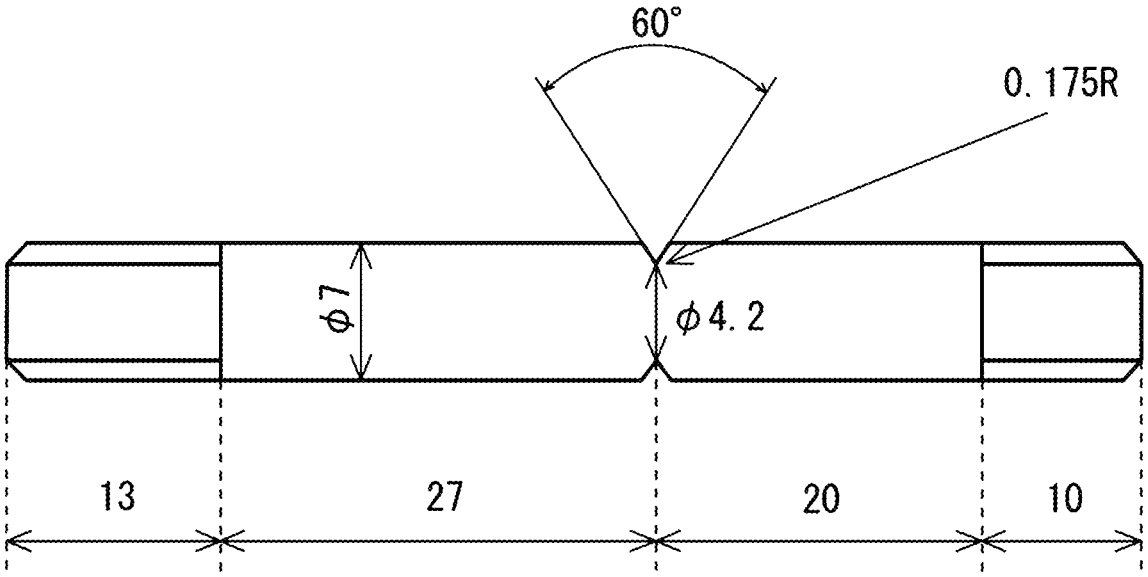
FIG. 2 is a view showing a ring-shaped V-notch test piece.

A rolled wire rod was quenched and tempered to adjust the tensile strength of the rolled wire rod to about 1200 MPa. Next, the wire rod adjusted in tensile strength was machined to obtain the ring-shaped V-notched test piece shown in FIG. 2. In FIG. 2, numerical values without units shown indicate the dimensions of the portion corresponding to the test piece (unit: mm). Further, in the figure, the "φ numerical value" indicates the diameter (mm) of a designated portion, "60°" indicates the V-notch angle, and "0.175R" indicates the V-notch bottom radius. Note that, 10 test pieces were prepared for each of the invention examples and comparative examples.

Next, for each of the invention examples and comparative examples, the electrolytic charge method was used to introduce various concentrations of hydrogen into a plurality of ring-shaped V-notched test pieces. Note that, the electrolytic charge method was performed as follows: That is, the test piece was immersed in an ammonium thiocyanate aqueous solution. In that state, an anode charge was generated at the surface of the test piece to introduce hydrogen into the test piece. After that, a zinc plating film was formed on the surface of the test piece to thereby prevent the dissipation of the hydrogen in the test piece.

After that, a constant load test was performed applying a constant load so that a tensile stress of a nominal stress of 1080 MPa was applied to the V-notch cross-section of the test piece. Both a test piece which broke during the test and a test piece which didn't break were measured for the amount of hydrogen in the test piece by temperature elevation analysis using a gas chromatograph. After measurement, for each of the invention examples and comparative examples, the maximum amount of hydrogen of the test piece which did not break was defined as the critical amount of diffusible hydrogen Hc.

Furthermore, the invention examples and comparative examples were evaluated based on the critical amount of diffusible hydrogen of steel having a chemical composition corresponding to SMC435 of JIS G4053 (2008), that is, as "Good" if the critical amount of diffusible hydrogen was 0.40 ppm or more and evaluated as "Not good" if it was less than 0.40 ppm.

(Investigation of Presence of Formation of Abnormally Coarse Grains)

A test piece worked in the investigation of the cold forgeability (deformation resistance and fracturing) was reheated and checked for the presence of any abnormally coarse grains. Specifically, a cold worked test piece was heated in an inert gas atmosphere in an 880° C. furnace for 30 minutes, then immersed in a 60° C. oil tank for quenching. The microstructure of the test piece was observed and the presence of any abnormally coarse grains was examined. To enable the internal structure of the test piece to be observed, the quenched test piece was cut parallel to its axial direction and buried in a resin. Next, the surface was corroded so as to enable the prior austenite grain boundaries to appear and the microstructure was examined by an optical microscope. The magnification was made 500×, and the position corresponding to D1/4 of the test piece before cold working (D1: diameter of test piece) was examined. If only regular grains were observed, the structure was judged as "Good", while if abnormally coarse grains were observed, the structure was judged as "Not good". Note that, a structure in which only regular grains were observed exhibited 5 to 30 μm or so prior austenite grains, while a structure in which abnormally coarse grains were observed exhibited mixed crystal grains grown to over 100 μm.

The results of the above explained investigation of the ferrite fraction (area %), form of inclusion (sulfide mean area ($\mu m^2$) and sulfide mean aspect ratio), cold forgeability (deformation resistance and fracturing), hydrogen embrittlement resistance, and formation of abnormally coarse grains are shown in Table 3 (regarding Invention Example A0 and Comparative Examples A1 to A6) and Table 4 (regarding Invention Examples 1 to 14 and Comparative Examples 15 to 25). Further, in Tables 3 and 4, whether or not the relationship of [Ti] and [S] shown in FIG. 1 is satisfied will also be described.

TABLE 3

| | No. | Relationship of [Ti] and [S] shown in FIG. 1 satisfied? | Ferrite fraction (area %) | Sulfide mean area ($\mu m^2$) | Sulfide mean aspect ratio | Cold forgeability: Deformation resistance (MPa) | Cold forgeability: Fracture | Cold forgeability: Overall evaluation | Hydrogen embrittlement resistance | Presence of formation of abnormally coarse grains |
|---|---|---|---|---|---|---|---|---|---|---|
| Inv. ex. | A0 | Satisfied | 47 | 3.91 | 3.01 | Good | Good | Good | Good | Good |
| Comp. ex. | A1 | Satisfied | 45 | 6.52 | 3.62 | Good | Not good | Not good | Not good | Not good |
| | A2 | Satisfied | 48 | 6.34 | 4.02 | Good | Not good | Not good | Not good | Good |
| | A3 | Satisfied | 38 | 4.01 | 2.35 | Not good | Good | Not good | Good | Good |
| | A4 | Satisfied | 39 | 3.95 | 2.56 | Not good | Good | Not good | Good | Good |
| | A5 | Satisfied | 46 | 6.40 | 3.70 | Good | Not good | Not good | Not good | Not good |
| | A6 | Satisfied | 47 | 6.20 | 4.10 | Good | Not good | Not good | Not good | Good |

TABLE 4

| | No. | Relationship of [Ti] and [S] shown in FIG. 1 satisfied? | Ferrite fraction (area %) | Sulfide mean area ($\mu m^2$) | Sulfide mean aspect ratio | Cold forgeability: Deformation resistance (MPa) | Cold forgeability: Fracture | Cold forgeability: Overall evaluation | Hydrogen embrittlement resistance | Presence of formation of abnormally coarse grains |
|---|---|---|---|---|---|---|---|---|---|---|
| Inv. ex. | 1 | Satisfied | 42 | 3.86 | 2.12 | Good | Good | Good | Good | Good |
| | 2 | Satisfied | 44 | 4.12 | 2.79 | Good | Good | Good | Good | Good |
| | 3 | Satisfied | 47 | 4.35 | 3.06 | Good | Good | Good | Good | Good |
| | 4 | Satisfied | 41 | 4.23 | 3.15 | Good | Good | Good | Good | Good |
| | 5 | Satisfied | 40 | 4.01 | 3.08 | Good | Good | Good | Good | Good |
| | 6 | Satisfied | 59 | 4.05 | 2.67 | Good | Good | Good | Good | Good |
| | 7 | Satisfied | 48 | 3.01 | 1.98 | Good | Good | Good | Good | Good |
| | 8 | Satisfied | 51 | 4.21 | 3.16 | Good | Good | Good | Good | Good |
| | 9 | Satisfied | 49 | 4.65 | 2.59 | Good | Good | Good | Good | Good |
| | 10 | Satisfied | 48 | 3.96 | 2.95 | Good | Good | Good | Good | Good |
| | 11 | Satisfied | 55 | 3.99 | 2.68 | Good | Good | Good | Good | Good |
| | 12 | Satisfied | 52 | 4.05 | 2.68 | Good | Good | Good | Good | Good |
| | 13 | Satisfied | 50 | 4.06 | 3.21 | Good | Good | Good | Good | Good |
| | 14 | Satisfied | 49 | 3.58 | 2.35 | Good | Good | Good | Good | Good |
| Comp. ex. | 15 | Not satisfied | 46 | 6.99 | 2.58 | Good | Not good | Not good | Not good | Not good |
| | 16 | Not satisfied | 52 | 3.26 | 2.56 | Not good | Good | Not good | Good | Good |
| | 17 | Satisfied | 61 | 4.02 | 2.98 | Good | Good | Good | Not good | Good |
| | 18 | Satisfied | 30 | 4.13 | 2.33 | Not good | Good | Not good | Good | Good |
| | 19 | Satisfied | 35 | 4.58 | 2.98 | Good | Not good | Not good | Good | Good |
| | 20 | Not satisfied | 43 | 7.28 | 4.12 | Good | Not good | Not good | Not good | Good |
| | 21 | Satisfied | 57 | 4.12 | 2.45 | Good | Good | Good | Not good | Good |
| | 22 | Satisfied | 46 | 3.48 | 2.56 | Not good | Good | Not good | Good | Good |
| | 23 | Not satisfied | 48 | 6.17 | 4.08 | Good | Not good | Not good | Not good | Not good |
| | 24 | Satisfied | 49 | 3.55 | 2.13 | Good | Good | Good | Not good | Good |
| | 25 | Satisfied | 26 | 3.17 | 2.64 | Not good | Not good | Not good | Good | Good |

According to Tables 3 and 4, each of Invention Example A0 and Invention Examples 1 to 14 has contents of all elements predetermined in the present application, has a relationship of content of Ti and content of S satisfying the range of the hatched region in FIG. 1, and further has a ferrite fraction, mean area of sulfides, and mean aspect ratio of sulfides in the ranges predetermined in the present application. For this reason, in each of Invention Example A0 and Invention Examples 1 to 14, it will be understood that suitable results are obtained in all of cold forgeability, hydrogen embrittlement resistance, and formation of abnormally coarsened grains.

As opposed to this, each of Comparative Examples A1 to A6 and Comparative Examples 15 to 25 does not have the contents prescribed in the present application for all elements, the relationship between the content of Ti and the content of S does not satisfy the range of the hatched region of FIG. 1, or the ferrite fraction, mean area of sulfides, and mean aspect ratio of sulfides are not within the ranges prescribed in the present application. For this reason, in Comparative Examples A1 to A6 and Comparative Examples 15 to 25, it is learned that good results are not obtained in at least one of the cold forgeability, hydrogen embrittlement resistance, and formation of abnormally coarse grains.

INDUSTRIAL APPLICABILITY

According to the present invention, rolled wire rod effectively suppressing fracturing at the time of cold forging and excellent in hydrogen embrittlement resistance after quenching and tempering following spheroidization annealing even without spheroidization annealing before cold forging or even if shortening the time period of spheroidization annealing can be provided. Therefore, the present invention is promising in particular in the point of being able to be used as a material for a cold forged part.

The invention claimed is:

1. A rolled wire rod comprising, by mass %,

C: 0.20% to less than 0.40%,

Mn: 0.10% to less than 0.40%,

S: less than 0.020%,

P: less than 0.020%,

Cr: 0.70% to 1.60%,

Al: 0.005% to 0.060%,

Ti: 0.010% to 0.080%,

B: 0.0003% to 0.0040%, and

N: 0.0020% to 0.0080% and having a balance of Fe and impurities, wherein:

the contents of Ti, N, and S (mass %) are respectively [Ti], [N], and [S], and if $[S] \leq 0.0010$, [Ti] is $(4.5 \times [S] + 3.4 \times [N])$ or more and $(0.008 + 3.4 \times [N])$ or less, while if $[S] \geq 0.0010$, [Ti] is $(4.5 \times [S] + 3.4 \times [N])$ or more and $(8.0 \times [S] + 3.4 \times [N])$ or less, the internal structure is a mixed structure of ferrite and pearlite with an area ratio of a ferrite fraction of 40% or more, and a mean area of sulfides present in a range from a surface of the wire rod to a depth position D/8 from the surface of the wire rod is 6 $\mu m^2$ or less, wherein D represents a diameter, in mm, in a cross-section of the wire rod at a plane including the axis of the wire rod, and a mean aspect ratio of the sulfides is 5 or less.

2. The rolled wire rod according to claim 1 comprising, instead of part of said Fe, by mass %, at least one type of Si: 0% to less than 0.40% and Nb: 0% to 0.050%.

3. The rolled wire rod according to claim 1 comprising, instead of part of said Fe, by mass %, at least one type of Cu: 0.50% or less, Ni: 0.30% or less, Mo: 0.05% or less, and V: 0.05% or less.

4. The rolled wire rod according to claim 1 comprising, instead of part of said Fe, by mass %, at least one type of Zr: 0.05% or less, Ca: 0.005% or less, and Mg: 0.005% or less.

5. The rolled wire rod according to claim 2 comprising, instead of part of said Fe, by mass %, at least one type of Cu: 0.50% or less, Ni: 0.30% or less, Mo: 0.05% or less, and V: 0.05% or less.

6. The rolled wire rod according to claim 2 comprising, instead of part of said Fe, by mass %, at least one type of Zr: 0.05% or less, Ca: 0.005% or less, and Mg: 0.005% or less.

7. The rolled wire rod according to claim 3 comprising, instead of part of said Fe, by mass %, at least one type of Zr: 0.05% or less, Ca: 0.005% or less, and Mg: 0.005% or less.

* * * * *